US005109616A

United States Patent [19]

Lush

[11] Patent Number: 5,109,616

[45] Date of Patent: May 5, 1992

[54] EMERGENCY SNOWSHOES CAPABLE OF BEING NESTED, HINGED AND LOCKED TOGETHER

[76] Inventor: Craig L. Lush, 8148 Cliffview Ave., Springfield, Va. 22153

[21] Appl. No.: 602,736

[22] Filed: Oct. 24, 1990

[51] Int. Cl.[5] ..... A43B 5/04

[52] U.S. Cl. ..... 36/122; 36/124; 36/125; 36/1

[58] Field of Search ..... 36/115-116, 36/134, 1, 7.5, 122-125; 280/813, 814, 816, 824

[56] References Cited

U.S. PATENT DOCUMENTS

| | | | |
|---|---|---|---|
| 2,410,702 | 11/1946 | Arsenault | 36/4.5 |
| 2,490,183 | 12/1949 | Wheeler | 280/11.37 |
| 3,687,472 | 8/1972 | Struble, Jr. | 280/11.37 |
| 3,798,801 | 3/1974 | Gros-Louis | 36/2.5 AB |
| 4,045,889 | 9/1977 | Woolworth | 36/122 |
| 4,085,529 | 4/1978 | Mansfield | 36/125 |
| 4,294,025 | 10/1981 | Keller | 36/132 |
| 4,620,375 | 11/1986 | Wallace | 36/7.6 |
| 4,720,928 | 1/1988 | Faber et al. | 36/122 |
| 4,744,584 | 5/1988 | Monreal | 280/606 |
| 4,793,627 | 12/1988 | Monreal | 280/606 |
| 4,958,446 | 9/1990 | Brown | 36/11.5 |

OTHER PUBLICATIONS

"How to Buy Snowshoes", *Backpacker*, 12th Issue, pp. 62-70.

*Primary Examiner*—Paul T. Sewell

[57] ABSTRACT

Snowshoes that have been designed to allow one shoe to be reversed, inverted and assembled onto the second, forming a container for storage of various items of emergency equipment. Constructed for longterm storage, such as in the trunk of a car or aboard a private plane, design includes a movable bracket to receive a field expedient handle for utilization as an emergency snow removal device.

1 Claim, 13 Drawing Sheets

FIG. 1B
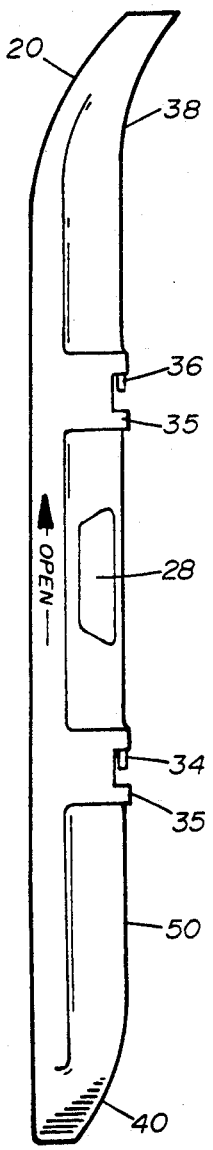
FIG. 1A
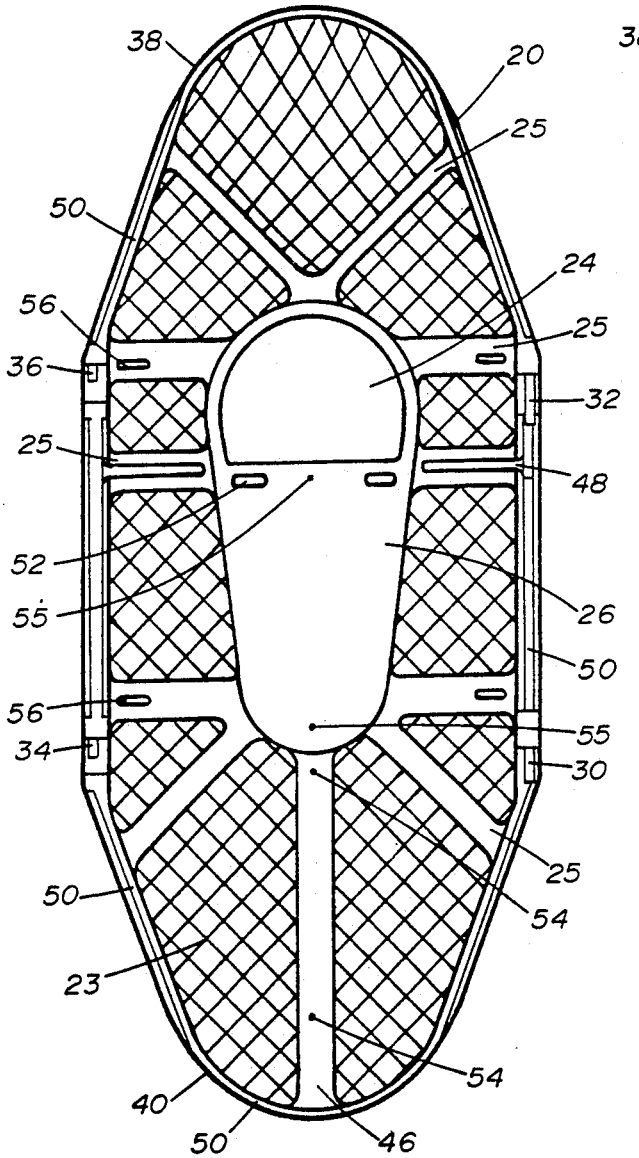
FIG. 1C
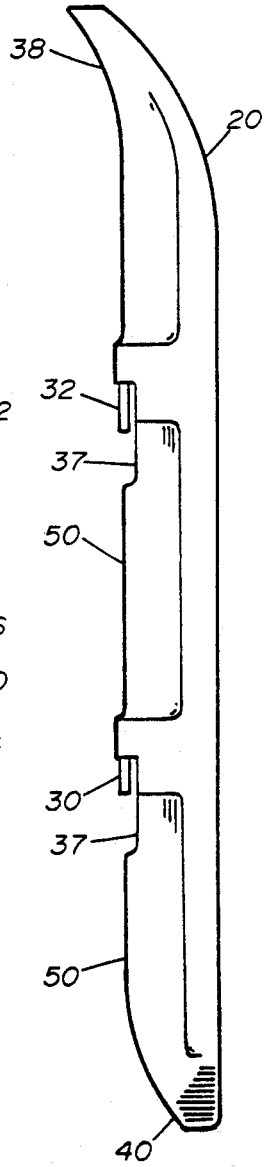
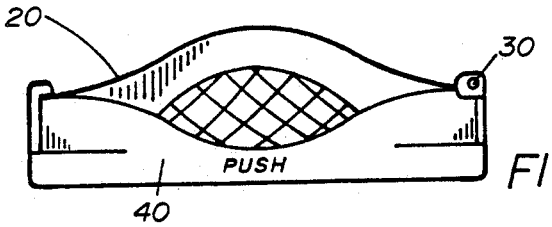
FIG. 1D

FIG. 2B
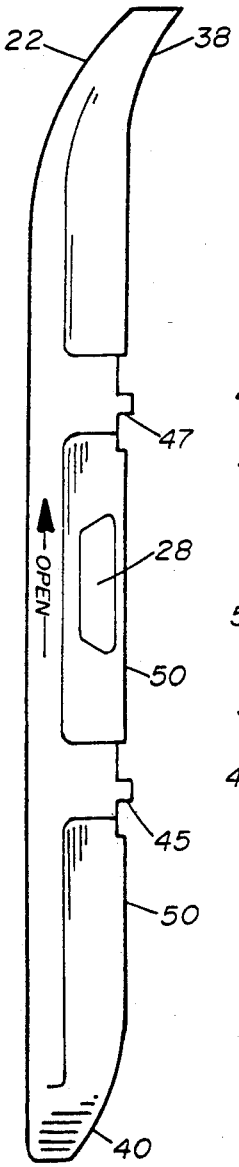
FIG. 2A
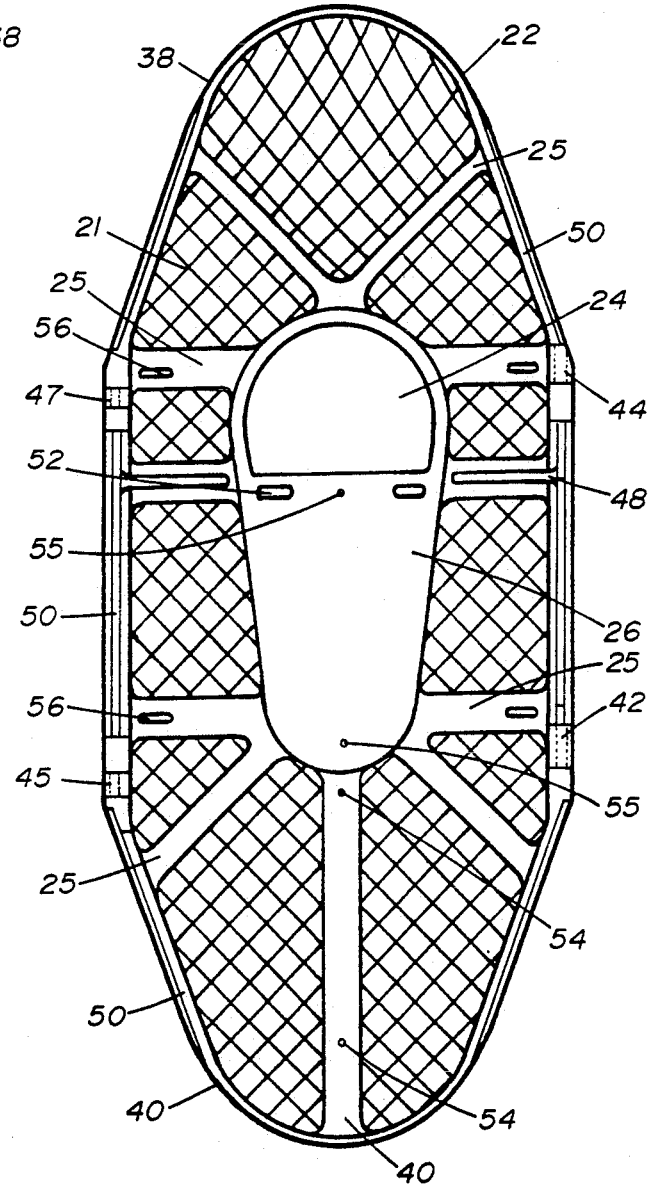
FIG. 2C
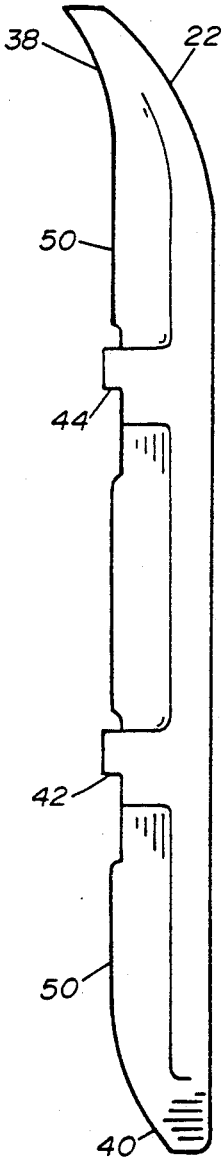
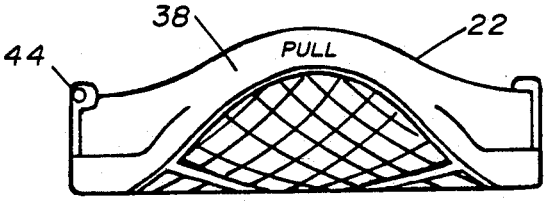
FIG. 2D

FIG. 3A
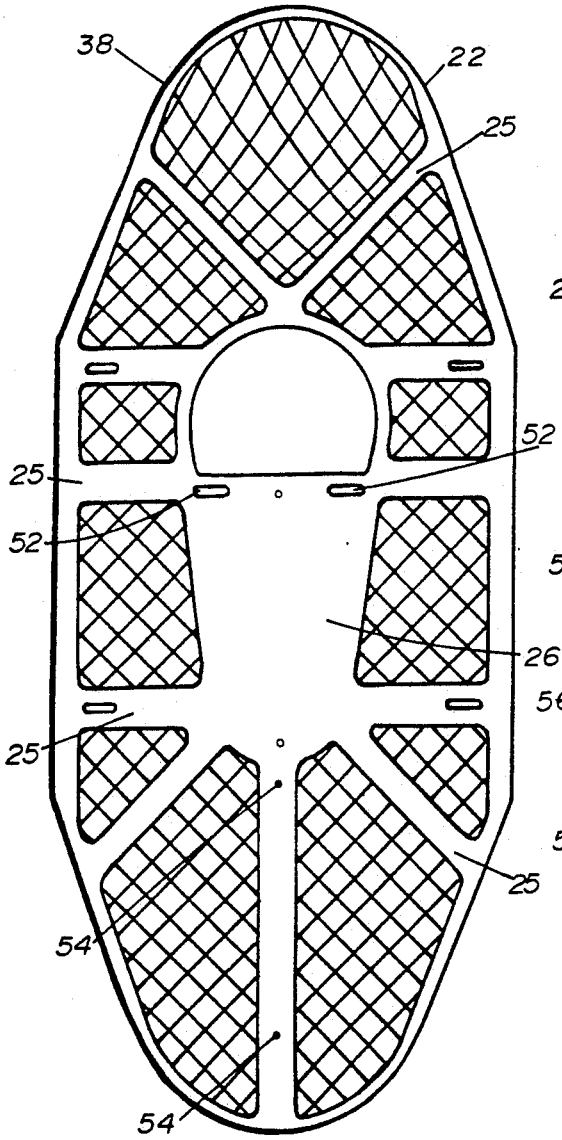
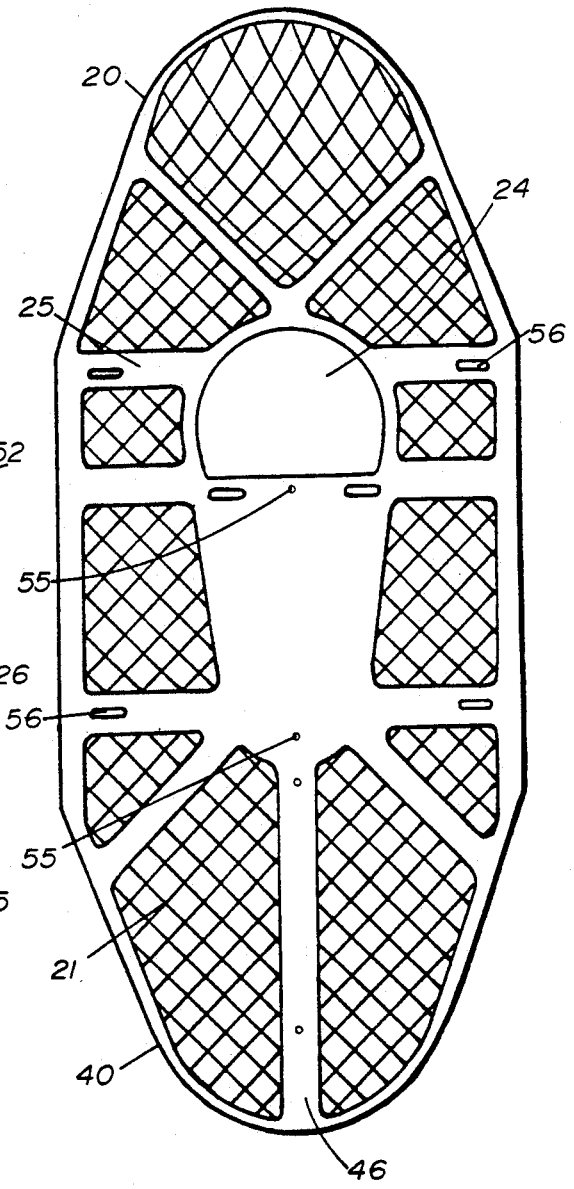
FIG. 3B

FIG. 4A
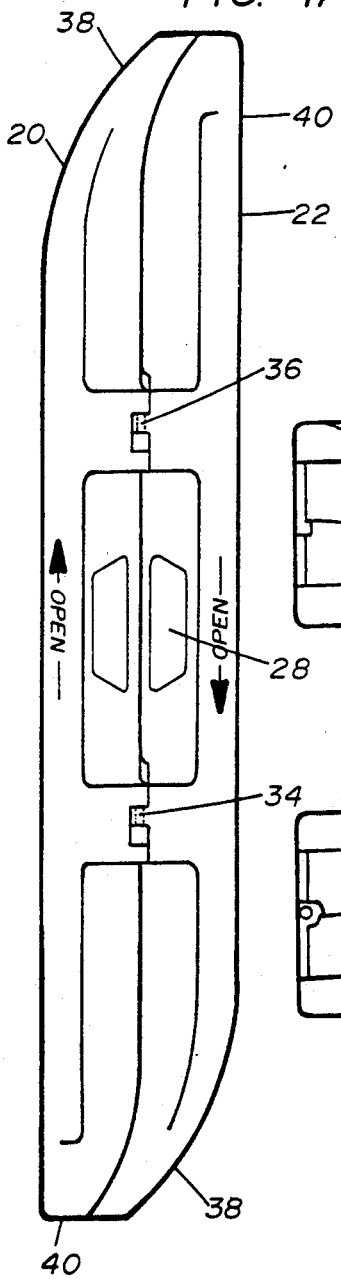
FIG. 4B
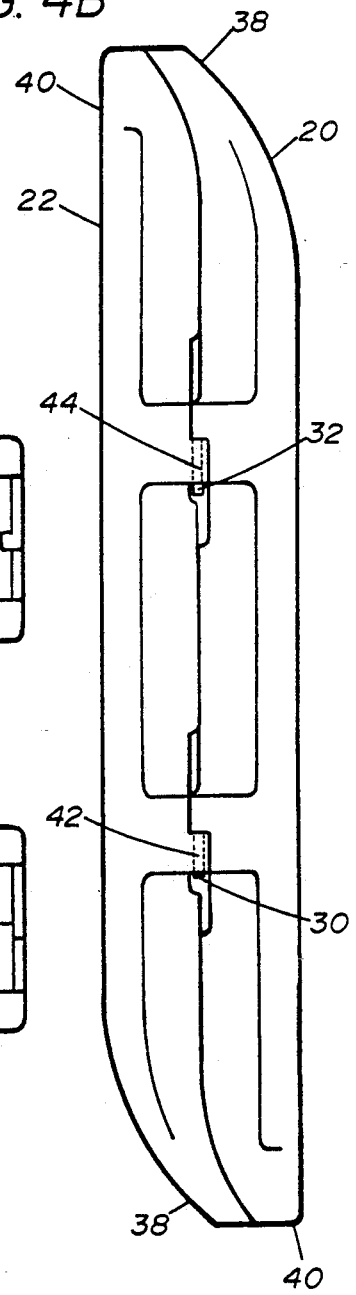
FIG. 4C
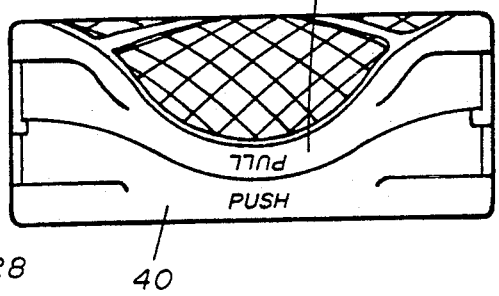
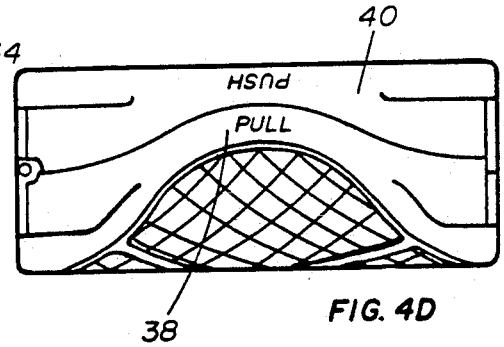
FIG. 4D

FIG. 7A
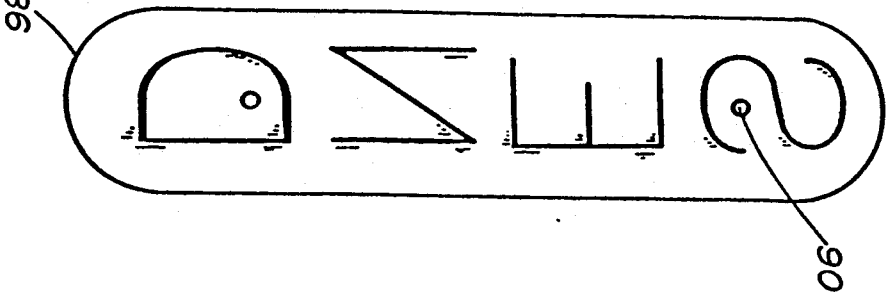
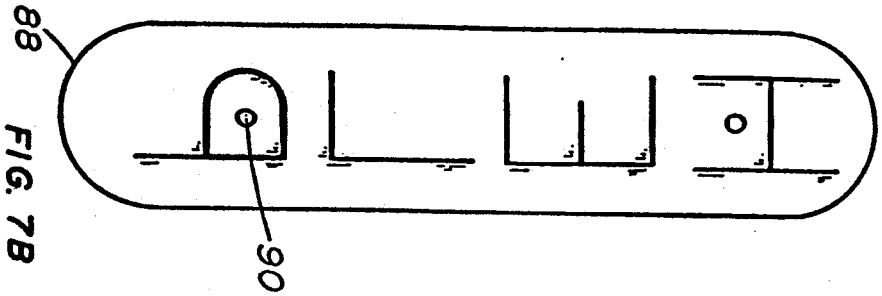
FIG. 7B
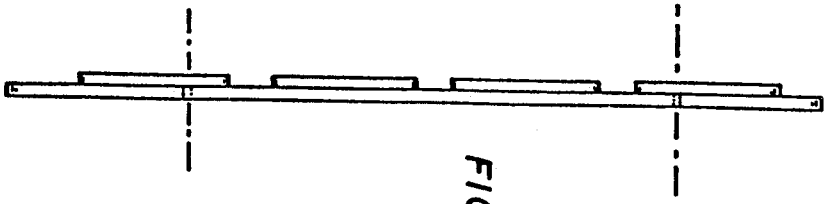
FIG. 7C

FIG. 8A
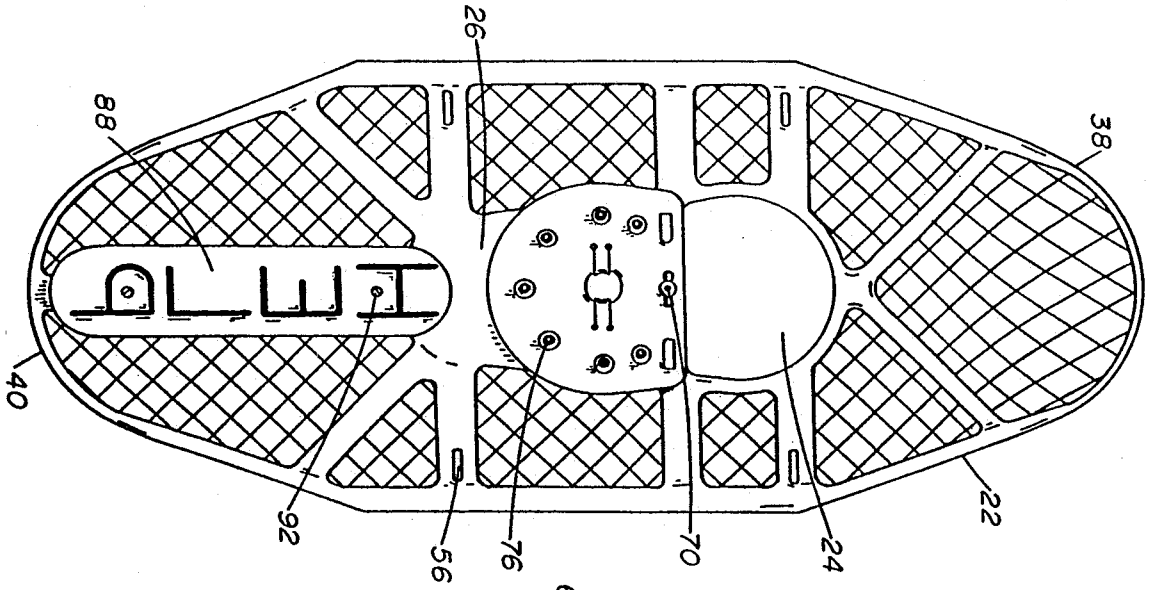
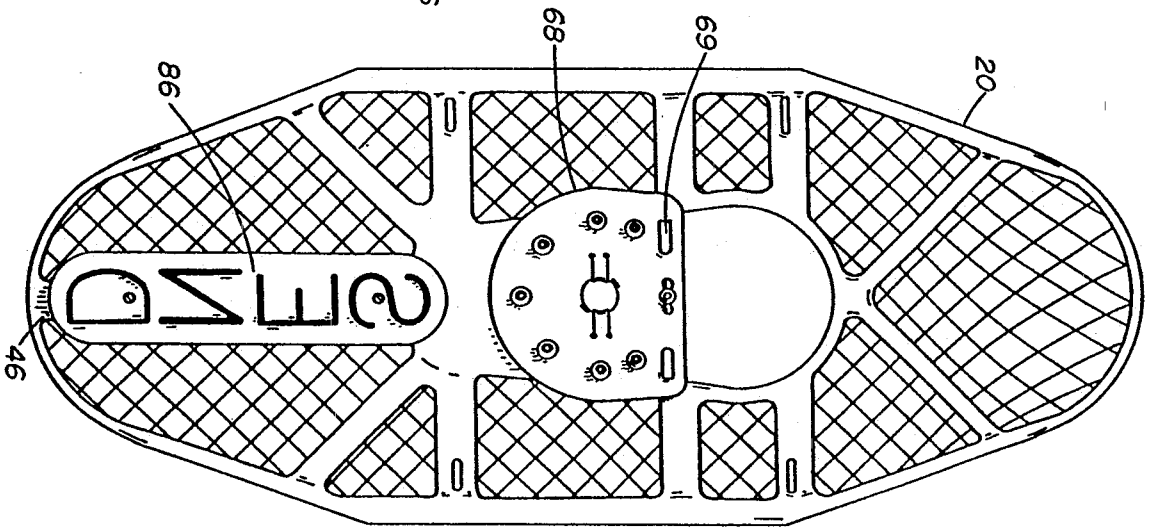
FIG. 8B

FIG. 9A
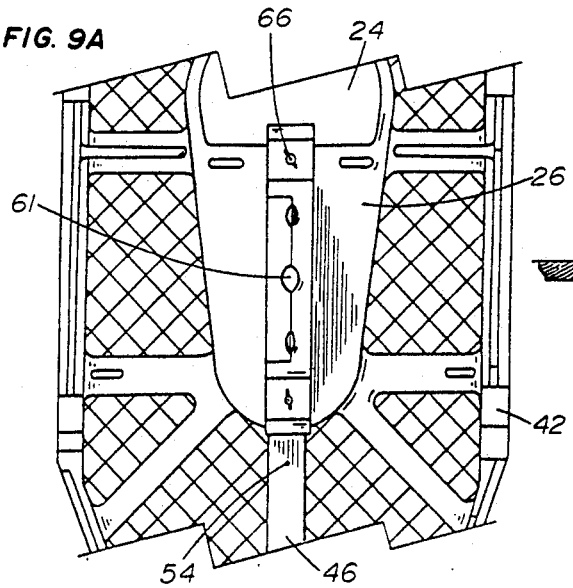
FIG. 9B
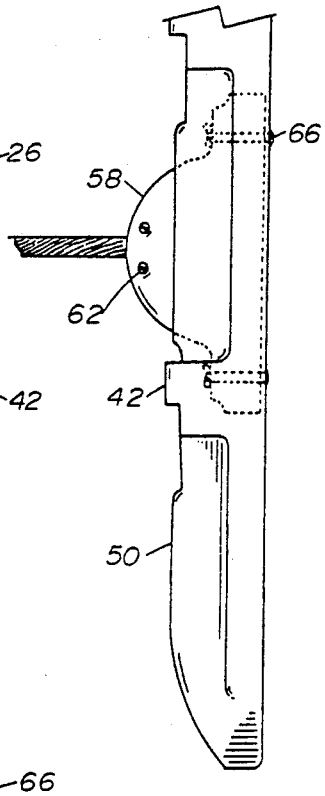
FIG. 9C
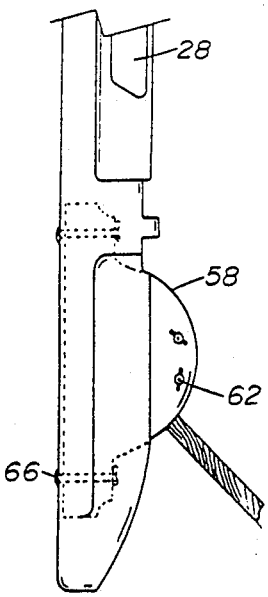
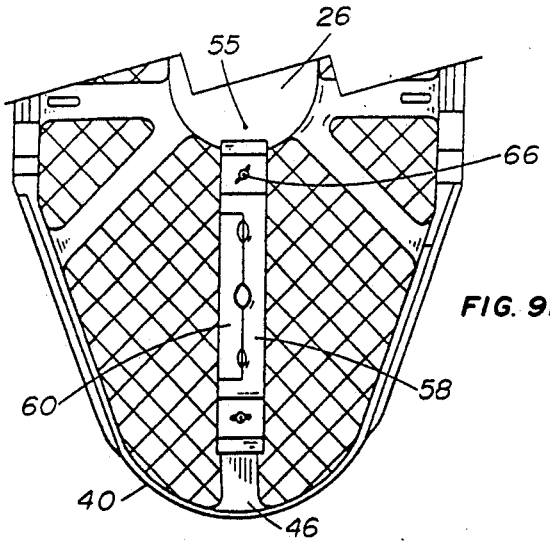
FIG. 9D

FIG. 12A
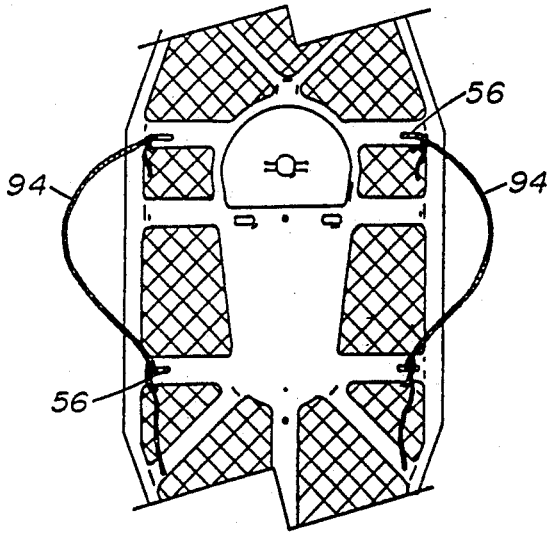
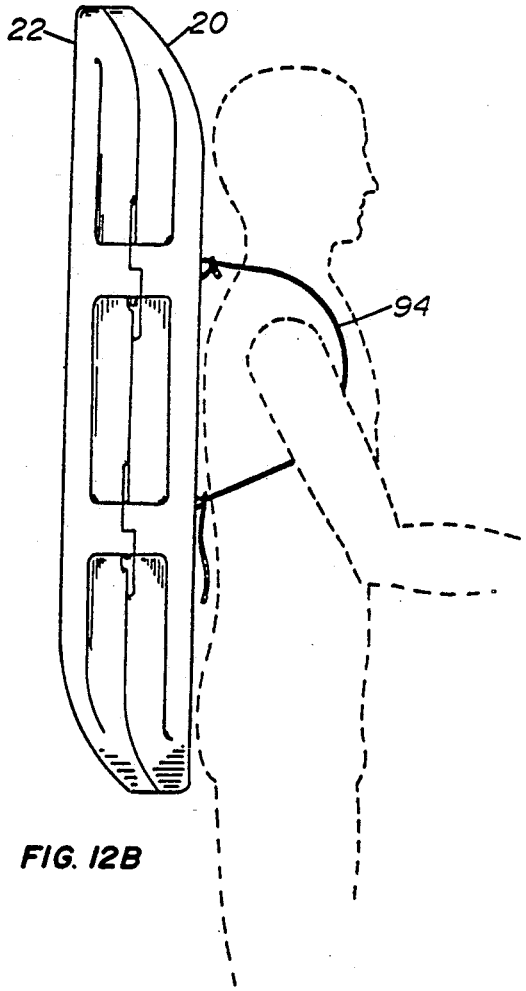
FIG. 12B

FIG. 13A
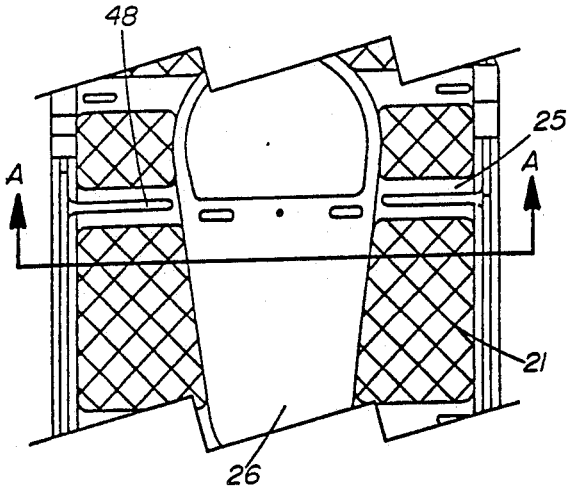
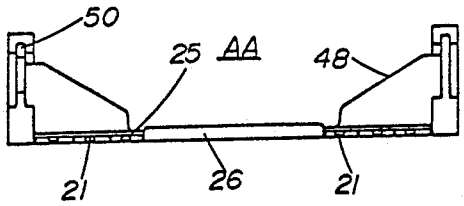
FIG. 13B

EMERGENCY SNOWSHOES CAPABLE OF BEING NESTED, HINGED AND LOCKED TOGETHER

BACKGROUND

1. Field of the Invention

This invention relates to snowshoes, specifically to snowshoes designed for long term storage and ultimate utilization in an emergency or life threatening situation.

2. Discussion of Prior Art

Heretofore, snowshoes have been a utilitarian item, adept at traversing soft snow by providing a large surface area (footprint) such that the weight of a human spread over this area was insufficient to penetrate the snow. This properly is commonly referred to as "flotation". The actual shape and size of the shoe varied with the environment in which they were to be used and the weight of the user. They were typically elliptical with a raised rounded toe to minimize the tendency of the shoe to torpedo into the snow during use, and a narrower trailing heel which provided directional stability. The plane created within the frame, is usually referred to as the "deck". A harness, which coupled the users footwear to the snowshoe was also necessary and usually designed to facilitate the normal pivoting action of the human foot, even though in this case, the toes extend through the shoe deck and into the snow. This action provided forward traction while, minimizing the bending action of the foot, which is usually difficult in heavy winter boots. In any case, the foot progresses in a forward motion and takes what would be normally considered the walking surface with it.

In every case, the snowshoe was large, awkward to carry and bulky to store. Attempts at coupling the pair for transport or storage were usually accomplished with the aid of several separate cords tied strategically around the perimeter. This was not an ideal solution, since even when the extra cords had not been misplaced, there are only two ways to logically configure the shoes. The first is to "stack" one atop the other, pointing in the same direction (dictated by the upward curve of the toe) and lash the frames together while compressing the harness of the lower shoe. The second, is to lash the bottoms together (walking surfaces facing), again with the toes and heels aligned. This configuration is even more cumbersome and subjected the shoes to possible damage, due to the toes extending beyond the deck plane in both directions. In each case they were difficult to manage, since the shoes did not interlock. The entire procedure is at best frustrating and usually ends with the individual shoes sliding in various (different) directions. This highlights the problem of exactly how one picks up and carries a pair of snowshoes that have been lashed together. There is no handle. Traditionally, one attempts to grasp the items with one hand, around one or both frames, or more frequently around the frame with the fingers through the webbing. Since the shoes can never be tightly secured, due to the harness standoff, this scenario can lead to injury if the two shoes slide in different directions, trapping the fingers between the two shoes. This can be significantly more serious should the carrier inadvertently hit one of the shoes on a solid object, or slip and fall upon the shoes. Since emergency snowshoes were, by definition, designed to be transported until needed for use, these various problems collectively contribute to the unsuitability of the prior art. In U.S. Pat. No. 3,798,801 to Gros-Louis, Mar. 26, 1974, for "Emergency Snowshoes in Particular for Stranded Snowmobilers" progress was made with the nesting characteristics; however, these items lacked adequate decking forward on the toe hole, and did not address the usefulness of an extended and upturned toe. No convenient means for securing the individual shoes together or for carrying the assembled pair was considered.

OBJECTS AND ADVANTAGES

Accordingly, several objects and advantages of my invention serve to minimize the problems that previously existed. This is accomplished by designing the snowshoes to be symmetrical front back, and side to side. Such a shape allows one of these shoes to be inverted and reversed for placement atop of and ultimately locked onto the second. Each shoe is designed to have a vertical wall extending above and around the perimeter, providing additional stability and serving to distribute the weight of the user over the entire length of the shoe. This is critical to maintaining shoe durability while reducing the cross-sectional area and weight of the deck. The void between the shoes, created by the vertical walls, when the two mated snowshoes are assembled, is ideal for storage of various items of emergency/survival gear. These items could include such things as a hatchet, hunting knife, compass, matches, metallic emergency blankets, extra cap or gloves, portable radio, etc.. Since the deck of both shoes is largely webbing, these items can be conveniently stowed or secured to the webs while still allowing adequate ventilation to preclude moisture build-up and the formation of mold, etc.. The design also provides a mechanical barrier against rodents that might cause damage to the contents. While assembled in storage, the toe hole of each snowshoe is designed to be closed with a removable piece material, dimensioned to snap into place, using a friction fit from the top of the deck and secured with a reversible carriage bolt and wing nut. Such a design does not impact the normal installation and function of the Lampwick harness configuration. This snowshoe design also includes a removable handle bracket that will receive a field expedient handle, thus allowing a shoe to be utilized as a crude emergency shovel or even as a tamping device for compacting snow. Subject bracket can be located rearward of either shoe for use as a snow removal device, or centered with the handle perpendicular to the shoe for tamping or use as a flagpole. Subject bracket is normally stowed on the top surface of one of the shoes, in the rearward storage location. In this position, it does not interfere with the normal assembly or operation of the shoe. This invention provides for utilization of the "Lampwick" harness configuration which is lightweight, simple to install and operate, and works well with a variety of shoe/boot styles. Should one of the harnesses be lost or damaged, a field expedient replacement can be devised from any suitable length rope, hide, or one of the various cords that are incorporated in most modern cold weather jackets. Since not all emergency situations will require an immediate lace-up of snowshoes to facilitate going for help, these shoes also incorporate provisions for utilizing the cords of the lampwick harness as shoulder straps, thus allowing the assembled shoes to become an emergency "backpack" in which to carry any survival gear that might be prudent as one walks for help. It is obvious that my invention minimizes or eliminates many of the shortcomings of the prior art. Further objects and advantages of my invention will become apparent from a consideration of the drawings and ensuing description of it.

DESCRIPTION OF DRAWINGS

FIG. 1A—Left Shoe Top View.
FIG. 1B—Left Shoe Outboard View.
FIG. 1C—Left Shoe Inboard View.
FIG. 1D—Left Shoe Heel View.
FIG. 2A—Right Shoe Top View.
FIG. 2B—Right Shoe Inboard View.
FIG. 2C—Right Shoe Outboard View.
FIG. 2D—Right Shoe Toe View.
FIG. 3A—Right Shoe Bottom View.
FIG. 3B—Left Shoe Bottom view.
FIG. 4A—Assembled Shoes Handle View.
FIG. 4B—Assembled Shoes Hinge View.
FIG. 4C—Assembled Shoes End View Right Shoe over Left.
FIG. 4D—Assembled Shoes End View Right Shoe over Left.
FIG. 7A—"Send" Message Board Bottom View.
FIG. 7B—"Help" Message Board Bottom View.
FIG. 7C—Message Board Edge View.
FIG. 8A—Right Shoe Bottom View with Ice Cleat and Message Board Installed.
FIG. 8B—Left Shoe Bottom View with Ice Cleat and Message Board Installed.
FIG. 9A—Right Shoe Top View with Assembled Handle Mounting Bracket installed over the Foot Plate.
FIG. 9B—Right Shoe Outboard View with Assembled Handle Mounting Bracket installed over the Foot Plate (with handle installed).
FIG. 9C—Right Shoe Inboard View with Assembled Handle Mounting Bracket installed in the rear position (with handle installed).
FIG. 9D—Right Shoe Top View with Assembled Handle Mounting Bracket installed in the rear position.
FIG. 12A—Shoe Bottom View with Harness Cord installed as shoulder strap.
FIG. 12B—Assembled Shoes Hinge View being worn as backpack.
FIG. 13A—Right Shoe Top View.
FIG. 13B—Right Shoe Section View.

LIST OF REFERENCE NUMERALS

20 Left Shoe (top and side views)
21 Webbing
Right Shoe (top and Side views)
Deck
Toe Hole
Deck Stringers
Foot Plate
Handle Hole
30 Hinge Pin (short)
32 Hinge Pin (extended)
34 Locking Pin
35 Stop Block
36 Locking Pin
38 Toe
40 Heel
42 Hinge
44 Hinge
45 Locking Pin Receiver
46 Heel Stringer
47 Locking Pin Receiver
48 Vertical Rib
50 Vertical Perimeter Wall
52 Harness Hole
54 Mounting Holes
55 Mounting Holes
56 Shoulder Harness Mounting Holes
58 Handle Mounting Bracket
60 Mounting Bracket Insert
61 Pole Receiving Cutout
62 Carriage Bolt/Wing Nut
63 Cutout Collar
64 Bracket Mounting Holes
66 Bracket Carriage Bolt/Wing Nut
68 Toe Hole Filler
69 Toe Hole Filler Harness Holes
70 Toe Hole Filler Carriage Bolt/Wing Nut
72 Toe Hole Filler Mounting Hole
74 Toe Hole Filler Ice Cleat
76 Ice Cleat Metal Insert
78 Toe Hole Filler Alignment Pins
80 Toe Hole Filler Friction Points
82 Ski Pole Receiver
84 Toe Hole Filler Flexible Locking Fingers
86 Removable Message Board (SEND)
88 Removable Message Board (HELP)
90 Removable Message Board Mounting Hole
92 Removable Message Board Carriage Bolt/Wing Nut
94 Lampwick Harness Cord

DESCRIPTION OF INVENTION

Figure 5A:
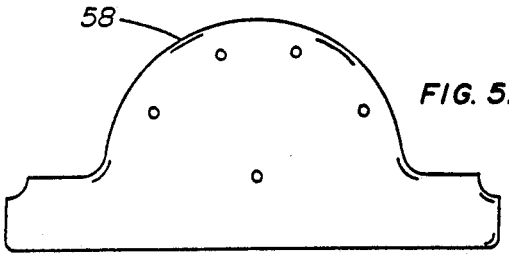
FIG. 5A—Handle Mounting Bracket Exterior Side View.
Figure 5E:
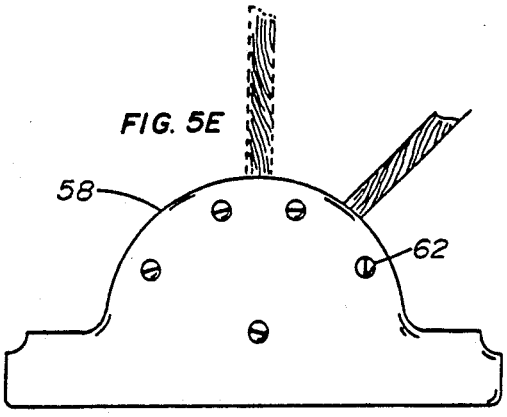
FIG. 5E—Handle Mounting Bracket Exterior View with Pole Installed.
Figure 5B:
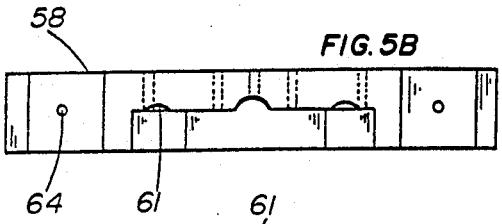
FIG. 5B—Handle Mounting Bracket Top View.
Figure 5F:
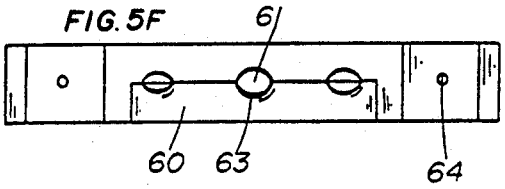
FIG. 5F—Handle Mounting Bracket with Insert installed Top View.
Figure 5C:
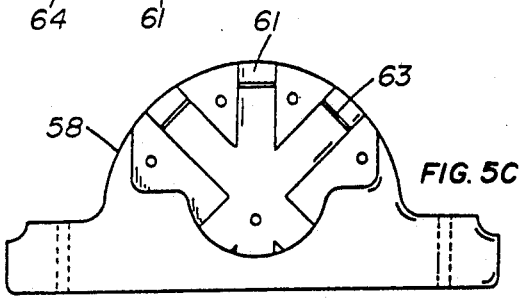
FIG. 5C—Handle Mounting Bracket Interior Side View.
Figure 5G:
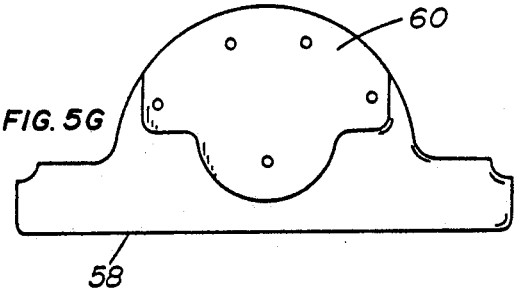
FIG. 5G—Handle Mounting Bracket with Insert installed Interior Side View.
Figure 5D:
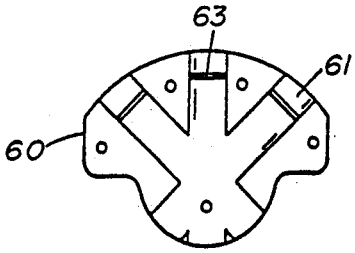
FIG. 5D—Mounting Bracket Insert Interior Side View.
Figure 5H:
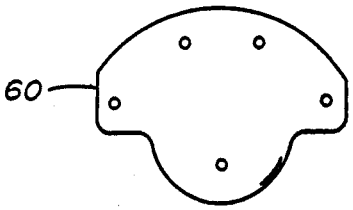
FIG. 5H—Mounting Bracket Insert Exterior Side View.
Figure 6A:
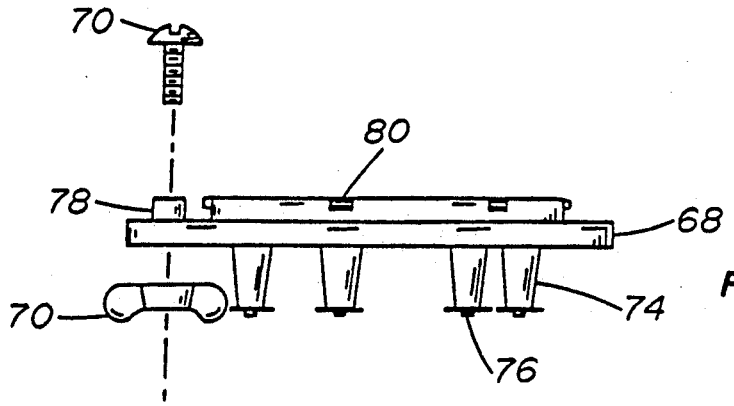
FIG. 6A—Toe Hole Filler Edge View.
Figure 6B:
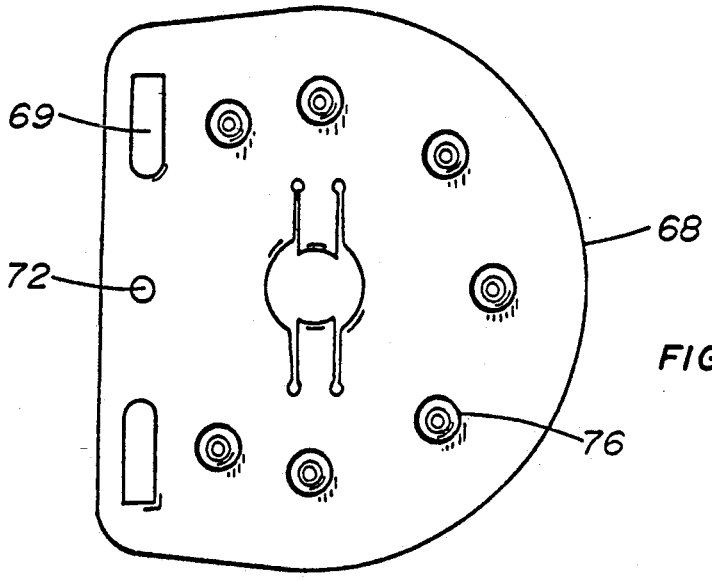
FIG. 6B—Toe Hole Filler Bottom (Ice Cleat) View.
Figure 6C:
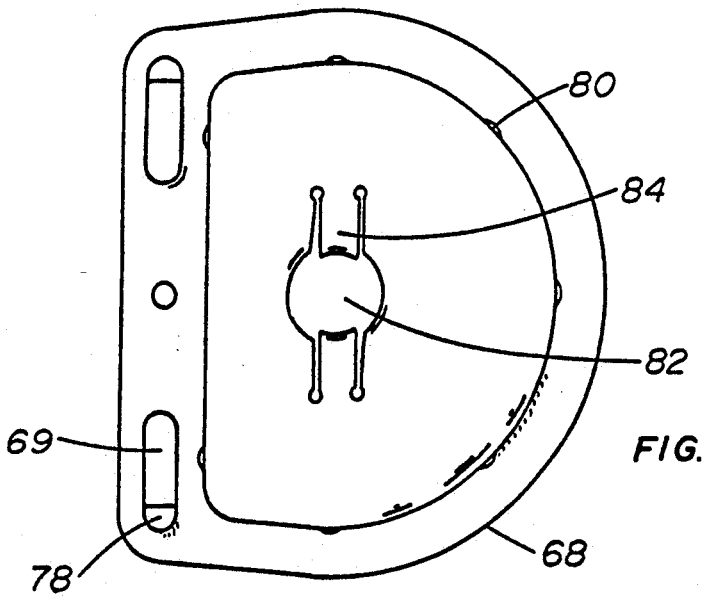
FIG. 6C—Toe Hole Filler Top View.
Figure 10A:
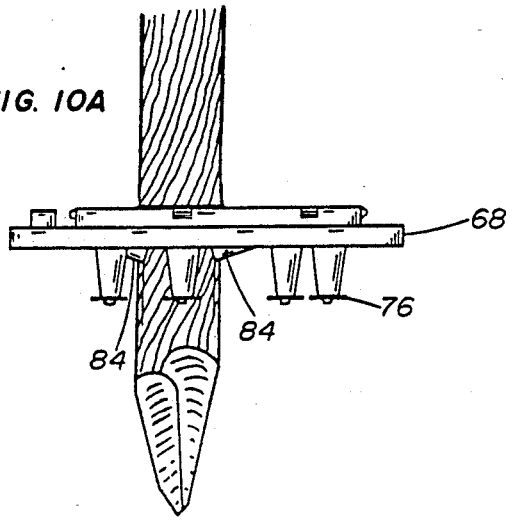
FIG. 10A—Toe Hole Filler with pole installed.
Figure 10B:
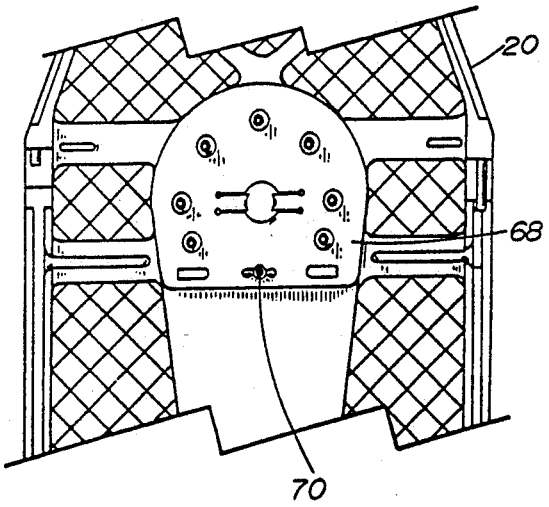
FIG. 10B—Left Shoe Top View with Toe Hole Filler in the stowed position.
Figure 10C:
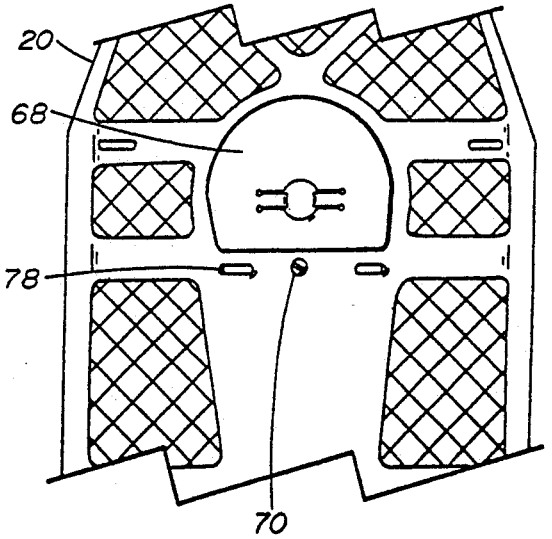
FIG. 10C—Left Shoe Bottom View with Toe Hole Filler in the stowed position.
Figure 11A:
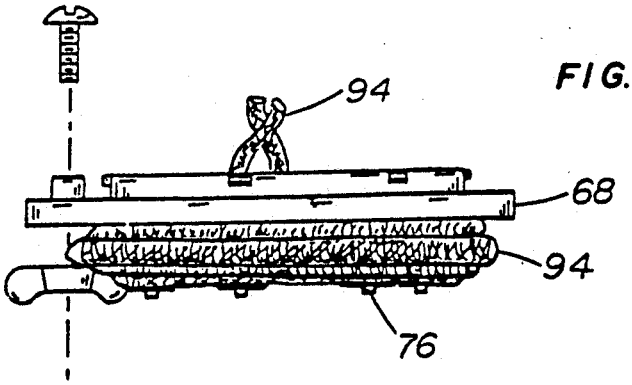
FIG. 11A—Toe Hole Filler Edge View with Harness Cord in the stowed position.
Figure 11B:
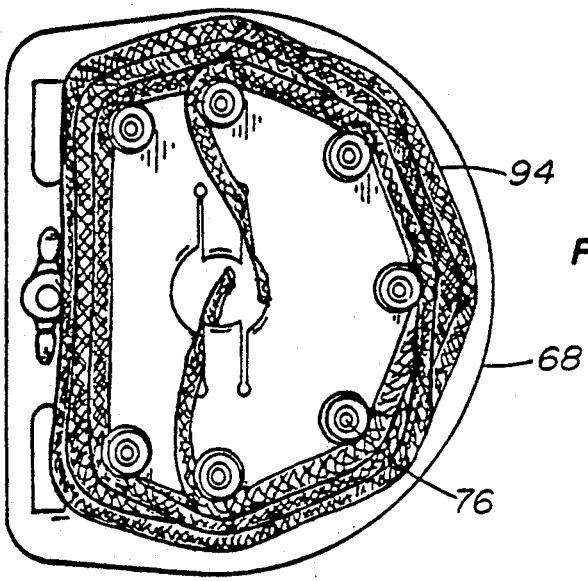
FIG. 11B—Toe Hole Filler Bottom View with Harness Cord in the stowed position.
Figure 11C:
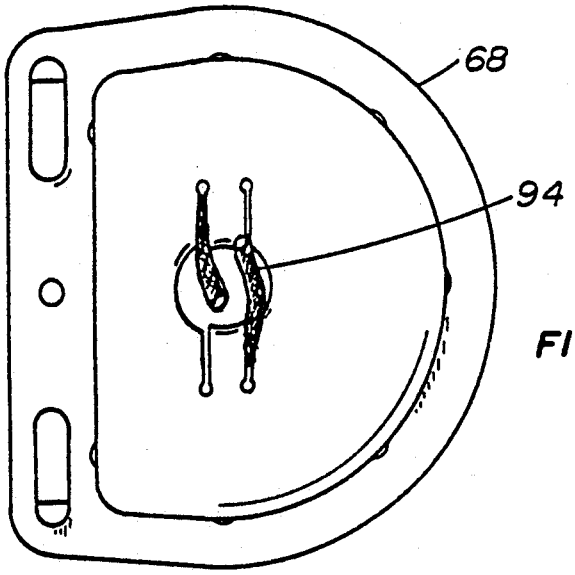
FIG. 11C—Toe Hole Filler Top View with Harness Cord in the stowed position.

As shown in FIGS. 1-10, my invention modifies the typical snowshoe design and construction in several significant ways. FIG. 1 is a top and side view of the left shoe (20). It is two dimensionally symmetrical around its longitudinal and transverse center axes. The perimeter of the shoe has a vertical wall (50) that extends around the entire circumference, varying in height at the toe (38) and the heel (40). This height variance accommodates the raised toe (38) by its reduced height at the heel (40). This technique allows a second, similarly shaped shoe to be inverted, reversed, placed atop and secured to this shoe (FIG. 4) creating a void or cavity between the two parallel shoe decks (23). A solid foot plate (26) is provided to receive the portion of the user's sole and heel that do not extend over the toe hole (24). This is a break with tradition, which dictates that the foot plate should be webbed to minimize the build-up of snow under the user's shoe. Since these snowshoes are designed to be used primarily as emergency equipment, it is possible that the user will not be wearing the traditional winter boot that is conducive to snowshoeing. The solid foot plate of this invention is designed to accept a wide variety of shoe/boot styles and sizes. Where the typical snowshoe would be unacceptable for women's raised heel footwear, this design accommodates most styles easily. Subject toe hole (24) extends through the deck of the shoe and allows the user to pivot the toes of his foot through this hole when walking. Two harness holes (52) are provided in the foot plate (26) to allow for the attachment of the user's shoe to the snowshoe via a Lampwick harness configuration. Additionally, the foot plate (26) contains a pair of mounting holes (55). Immediately adjacent to the harness holes (52) are the vertical ribs (48), attached to and extending above a pair of deck stringers (25), additional deck stringers (25) allow a portion of the user's weight to be distributed to the vertical perimeter wall (50). This technique provides strength and stability while allowing a reduction in the total cross-sectional area of the deck (23) components. A heel stringer (46) is provided from the center of the heel (40) to the center rear of the foot plate (26). This heel stringer (46) also incorporates a pair of mounting holes (54). The remainder of the deck (23) is comprised of the additional deck stringers (25) that serve to carry the remainder of the user's load to the shoe perimeter. The combination of these various deck stringers (25) and webbing (21) comprise the deck (23). The specific orientation and cross-sectional area of the webbing strands (21) is a function of the strength characteristics and construction techniques of the material being used. The webbing strand shape may be circular to elliptical, the specifics may be easily established by anyone versed in the art of production techniques. One side of the vertical perimeter wall (50) incorporates two hinge pins (30) and (32). Hinge pin (30) is shorter in length than its counterpart (32). These pins may be formed as an integral part of the shoe during manufacture or installed subsequent to initial forming. On the opposite side of the vertical perimeter wall (50) are two locking pins (35) and (36). Subject locking pins are identical in length and dimension. Located rearward of each locking pin is a stop block (35). Below the locking pins (34 and 36) in the vertical perimeter wall (50) is a handle hole (28). FIG. 2 is a top and side views of the right shoe (22). The major differences between the left and right shoes lies in the hinge mechanism. On this shoe, hinges (42 and 44) are designed to engage hinge pins (30 and 32 of FIG. 1) respectively. On the opposite side of the vertical perimeter wall (50) there are two locking pin receivers (45 and 47) that are designed, as indicated by their name, to engage the locking pins (34 and 36) of FIG. 1. Also visible on this view are four shoulder harness mounting holes (56) that are located at the outboard corners of the parallel deck stringers (25). FIG. 3 is a bottom view of the snowshoe pair. FIG. 4 shows the various views of the assembled shoes. FIG. 5 is a detail view of the handle mounting bracket (58). This unit is designed to accept a field expedient handle and, as with all the carriage bolt/wing nut configurations, can be operated without tools in a cold environment while wearing normal hand protection. The primary handle mounting bracket (58) contains several pole receiving cutouts (61) each of these cutouts (61) having a cutout collar (63). The handle mounting bracket (58) is completed with a mounting bracket insert (60) that has similar pole receiving cutouts (61) and cutout collars (63). When the mounting bracket insert (60) is installed in the handle mounting bracket (58) and held in place by the carriage bolt/wing nuts (62) a field expedient handle can be installed within one of the pole receiving cutouts (61) and be secured by the carriage bolt/wing nuts (62). Since each of the three pole receiving cutouts (61) are surrounded by three carriage bolt/wing nuts (62) the mounting bracket insert (60) can be tightened securely, thus trapping the field expedient handle between the mounting bracket (58) and the mounting bracket insert (60). The purpose of the cutout collar (63) is to cause a deformation, or bite, in the handle thus serving to trap the handle and minimize the tendency to slide out of the handle mounting bracket (58) when in use. The entire assembly is secured to the top of a snowshoe with carriage bolts/wing nuts (66 FIG. 9) through the handle bracket mounting holes (64) and the snowshoe mounting holes (54 or 55 FIG. 9). FIG. 6 contains views of the toe hole filler (68), used to fill the toe hole of the assembled snowshoes thus providing continuity of the container by covering the large diameter toe hole (24 of FIG. 1, 2, 3) in each shoe. This is done by installing the toe hole filler (68) in the tow hole (24). In this configuration, the toe hole filler (68) is held in place by the toe hole filler friction points (80), the toe hole filler carriage bolt/wing nut (70) extending through the toe hole plate mounting hole (72) and the forwardmost mounting hole of (55) and aligned by the toe hole plate alignment pins (78) which extend above the outboard most portion of the toe hole filler harness holes (69) and through the snowshoe harness holes (52) of the foot plate (26). FIG. 9 demonstrates the installation of the handle mounting bracket (58) on a snowshoe (20 or 22).

FIG. 12 provides a view of the assembled shoes being utilized as a backpack by tying the harness cords (94) through the shoulder harness mounting holes (56). FIG. 13 is a cross-section of a typical shoe, providing configuration of vertical rib (48) and deck webbing (21).

OPERATION OF INVENTION

Every attempt has been made to make the operation of this invention as simple and intuitive as possible. It is anticipated that the snow shoes (20 and 22) would be carried assembled (FIG. 4) in the trunk of a car or aboard a private plane. Within the cavity created by the vertical perimeter walls (50) of the shoes (20 and 22) one would normally store various items of emergency equipment such as a small hatchet, hunting knife, flashlight, emergency blanket, hat, gloves, candy etc.. Should an emergency occur, such as an automotive mechanical failure or becoming stranded in a snowstorm, one would dig the assembled snowshoes out of the trunk and using the "open" arrows on the side of the case beneath the carrying handle, or the "push/pull" instruction on each end of the snowshoes (20 and 22), slide the two shoes in opposite directions along their longitudinal axis until the diametrically opposed motion is stopped by the locking pin stop blocks (35). The only possible actions from here are to slide the shoes back together as they originally were, or to open the shoes, much like a book, by separating the handle holes (28). The shoes remain hinged together on the side opposite the handle and open to expose the various items of emergency gear available. If the decision is made to attempt to walk out, the shoes may be disassembled by continuing the original opposed motion. Once this action has been started, the design of my invention is such that the shoes will not completely close again until the locking pin receivers (45 and 47) are properly aligned between the stop blocks (35) and the locking pins (34 and 36). This is a safety precaution to minimize the possibility of suffering serious injury to the fingers should the individual shoes, which may have emergency equipment lashed to them and thus be heavy, slam together inadvertently. To disassemble the shoes, the original opposition motion will cause first the shorter hinge pin (30) to disengage and then the extended hinge pin (32) to disengage. This controlled sequence of disassembly serves to is facilitate reassembly by allowing the user to concentrate on but one hinge at a time, as opposed to trying to get both hinges "started" at once. The beauty of utilizing the Canadian Lampwick harness configuration is its simplicity of hardware and installation. The harness consists of essentially two six foot cords, one for each foot, that are installed by placing the ball of ones foot over the rearward portion of the toe hole (24) allowing the front of the foot, including the toes, to extend into the toe hole (24). Now, taking the separate ends of one of the cords (94) and threading each down through one of the harness holes (52) allowing the center of the cord to capture the ball portion of the foot. Next both ends are brought up through the toe hole (24) on their respective sides of the foot and stretched the length of the foot, crossing as they proceed around the back of the ankle. They next proceed forward, now on opposite sides of the shoe from where they started, and cross again in front of the ankle, over the instep. They now loop under the cord stretched between the toe hole (24) and the back of the ankle and are tied together atop the instep. The advantages of this configuration are numerous. The harness is simple to install and operate. There are no complex adjustments to be made and almost no limit to the size and variety of shoes/boots that it can be utilized with. Should one of the cords be lost or damaged, there are several obvious solutions from tying together the broken pieces to utilizing a less than critical piece of electrical wiring from an automobile to substitute for a missing unit. Additionally, the cords lend themselves to several other uses in emergency situations. In this case, should the individual not wanted to utilize the snowshoes immediately, but carry the shoes and all of the emergency gear, the cords could have been pressed into service by tying them through the shoulder harness mounting holes (56) and strapping the assembled shoes onto his back as an emergency backpack. Should it be necessary to move large quantities of snow, in an attempt to free an stuck automobile or build an igloo for a temporary shelter, a branch or sapling may be located, acquired and pressed into service in one of the pole receiving cutouts (61) of the handle mounting bracket (58). To utilize the snowshoes (20 or 22) as a crude shovel, the pole would be mounted in one of the cutouts forming an acute angle with the snowshoes deck (23) and the mounting bracket be installed in the snowshoe aft mounting holes (54) as illustrated in FIG. 9. If a device for tamping or compacting snow is needed, then the same pole and mounting bracket assembly should be moved to the forward snowshoe mounting holes (55) and the pole should be moved to the handle mounting bracket (58) pole receiving cutout (61) that is perpendicular to the snowshoe deck (23), again, as illustrated in FIG. 9.

CONCLUSION, RAMIFICATIONS AND SCOPE OF INVENTION

Thus the reader will see that the snowshoes of my invention provide a multipurpose device that can be used by persons of a wide range of sizes, skill and physical ability. While my above description contains many specificities, these should not be construed as limitations on the scope of the invention, but rather as an exemplification of one preferred embodiment thereof. Many other variations are possible. For example, the shoes could be used as a crude net for placing across a nearly frozen stream to trap fish, or by multipoint suspension a shoe could be weighted with rocks and suspended through the ice to lay upon the bottom of a lake or stream capturing fish within the shoes vertical walls while moving in a jigging motion. They might also be used as a door support for an emergency igloo or as protection from icicles falling from trees during a windstorm. The handle mounting bracket could have three poles installed and inverted. When the poles were spread in three directions the unit would stand, forming the framework for a crude shelter that could be covered with evergreen branches. Accordingly, the scope of my invention should be determined not by the embodiment illustrated, but by the appended claims and their legal equivalents.

Specifically, I claim:

1. A pair of emergency snowshoes able to be nested together to form a back-pack with a cavity for carrying articles, each snowshoe comprising:

a top surface for receiving a foot, a bottom surface for contact with snow, a deck portion which consists of a front, mid and rear section, the deck portion being essentially flat except for the forward tip of the front section being curved upwardly, the deck portion being peripherally symmetric about a central longitudinal axis and a central transverse axis, a toe hole within the mid-section of the deck, a vertical wall extending continuously around the periphery of the deck at varying heights, the wall containing hinge means and locking means, each on a respective longitudinal side, the hinge means and the locking means arranged on each snowshoe such that when the top surface of a first snowshoe is facing the top surface of a second snowshoe, which is rotated 180 degrees from its mirror-image position, the first snowshoe can nest with the second snowshoe, allowing the respective hinge means and locking means of each snowshoe to mate thus forming a secure cavity between the decks.

* * * * *